US006370907B1

(12) United States Patent
Sekiguchi et al.

(10) Patent No.: US 6,370,907 B1
(45) Date of Patent: Apr. 16, 2002

(54) AIR CONDITIONER

(75) Inventors: Kazunobu Sekiguchi; Hiroshi Nakashima; Atsushi Edayoshi; Tatsuo Sone; Manabu Asahina; Ryo Oya; Takashi Ikeda, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/609,642

(22) Filed: Jul. 3, 2000

(51) Int. Cl.[7] ..... F25D 17/06; F24F 1/00

(52) U.S. Cl. ..... 62/426; 62/407; 454/233

(58) Field of Search ..... 62/426, 407, 412, 62/418, 428; 454/233, 236

(56) References Cited

U.S. PATENT DOCUMENTS 4,876,070 A 10/1989 Tsukahara et al.

FOREIGN PATENT DOCUMENTS

| | | | |
|---|---|---|---|
| EP | 0 926 451 | | 6/1999 |
| JP | 60-114648 | | 6/1985 |
| JP | 61-280327 | | 12/1986 |
| JP | 62-178822 | | 8/1987 |
| JP | 63029146 | A * | 2/1988 |
| JP | 04-032625 | | 2/1992 |
| JP | 04-198634 | | 7/1992 |
| JP | 04198634 | A * | 7/1992 |
| JP | 6-341659 | | 12/1994 |
| JP | 10-038305 | | 2/1998 |
| JP | 10196591 | A * | 7/1998 |
| JP | 10220791 | A * | 8/1998 |
| JP | 0926451 | A1 * | 6/1999 |

* cited by examiner

*Primary Examiner*—Denise L. Esquivel
*Assistant Examiner*—Chen-Wen Jiang
(74) *Attorney, Agent, or Firm*—Oblon, Spivak, McClelland, Maier & Neustadt, P.C.

(57) ABSTRACT

An air conditioner including a centrifugal blower disposed in a central portion within a casing of an air conditioner main body, a heat exchanger disposed around the centrifugal blower, a heat insulation material for forming blow-off air course disposed between the heat exchanger and an inner wall surface of the casing on the inner wall surface, a panel mounted to a lower end portion of the casing, a suction port formed in a central portion of the panel, and a plurality of blow-off ports formed in side edge portions of the panel. The blow-off air course has a narrow portion configured to enhance a uniformity of a velocity distribution of and air flow in the blow-off air course, the guide comprises an acoustic material, and an air layer is provided between the casing and guide.

11 Claims, 4 Drawing Sheets

AIR CONDITIONER

BACKGROUND OF THE INVENTION

The present invention relates to an air conditioner, and more particularly to a structure for realizing uniformalization in wind velocity distribution of air which passes through its heat exchanger.

As a conventional ceiling embedded-type air conditioner, there is known an air conditioner disclosed in, for example, Japanese Patent Laid-Open No. 6-341659. FIG. 6 is a sectional view showing the ceiling embedded-type air conditioner. In FIG. 6, a reference numeral 1 denotes an air condition main body, which has a motor 5 in the central portion within a casing 2 configuring the main body 1, and a centrifugal blower 6 is fixed to the tip end of the shaft of the motor 5. A reference numeral 6*a* denotes a main plate of the centrifugal blower 6; and 6*b*, an air blower shroud. A heat exchanger 7 is arranged around the centrifugal blower 6, and on the inner wall surface of the casing 2, there is disposed heat insulation material 10 for forming a blow-off air course 8 between the inner wall surface and the heat exchanger 7. At the lower end portion of the casing 2, there is mounted a panel 9, in the central portion of the panel 9, there is formed a suction port 3, and in the side edge portions, there are formed blow-off ports 4. A reference numeral 2*a* denotes a casing corner portion.

The description will be made of the operation. When the centrifugal blower 6 is driven by the motor 5, indoor air is sucked into the air conditioner main body 1 through the suction port 3. The air thus sucked in is pushed out on the heat exchanger 7 side by the centrifugal blower 6, and after heat exchanged by passing through the heat exchanger 7, passes through a blow-off air course 8 on the secondary side of the heat exchanger, and is conducted indoors through the blow-off port 9.

FIG. 7 is a view showing blow-off wind velocity distribution of the centrifugal blower in the conventional ceiling embedded-type air conditioner. The air sucked into the air conditioner main body 1 through the suction port 3 is bent in a direction at right angles by the centrifugal blower 6 and is pushed out on the heat exchanger 7 side, and therefore, in the wind velocity blown from the centrifugal blower 6, there takes place such inclination in distribution that the wind velocity becomes slower toward the blower shroud 6*b* side and faster toward the main plate 6*a* side as shown in FIG. 7.

The conventional ceiling embedded-type air conditioner has had a problem that the capacity must be made larger because there is inclination in wind velocity distribution on passing through the heat exchanger 7 because of the above described configuration, and therefore, it has inferior heat exchange efficiency, and cannot make the most of the performance of the heat exchanger 7.

Also, there has been a problem that disturbance due to eddy current takes place, or great pressure loss due to sharp deflection occurs in the casing corner portion 2*a*, resulting in loud noise because the air which passed through the heat exchanger 7 collides with the inner wall surface made of the heat insulation material 10, is bent in a direction at right angles and flows toward the blow-off port 4.

SUMMARY OF THE INVENTION

The present invention has been achieved in order to solve the above described problems, and is aimed to provide an air conditioner capable of making the most of the heat exchanger's performance to reduce the capacity in which wind velocity distribution of the air which passes through the heat exchanger becomes uniform, the pressure loss on passing through the heat exchanger is reduced and the noise is muffled.

According to the present invention, there is provided an air conditioner having a centrifugal blower in the central portion within a casing configuring an air conditioner main body, in which a heat exchanger is disposed around the centrifugal blower, heat insulation material for forming the air conditioner main body, heat insulation material for forming a blow-off air course is disposed between the heat exchanger and the inner wall surface of the casing on the inner wall surface, a panel is mounted to the lower end of the casing, a suction port is formed in the central portion of the panel, and blow-off ports are formed in the side edge portions, in which the width of the blow-off air course on the upstream side is smaller than that on the downstream side.

Also, on the inner wall surface of the casing, there is provided a guide for making the width of the blow-off air course on the upstream side smaller than that on the downstream.

Also, an air conditioner is configured so that the width of the blow-off air course on the upstream side smaller becomes one third to two thirds of that on the downstream side.

Also, the guide is integrally formed of heat insulation material disposed on the inner wall surface of the casing.

Also, the guide is formed of acoustic material such as acoustic plastic, and an air layer is provided between the casing and the guide.

An air conditioner according to the present invention is capable of uniformalizing the wind velocity distribution of the air which passes through the heat exchanger because the width of the blow-off air course on the upstream side is set smaller than the width on the downstream side. Therefore, it becomes possible to reduce the pressure loss on passing through the heat exchanger, for muffling the noise, and to make the most of the heat exchanger's performance for reducing the capacity.

Since the guide is integrally formed of heat insulation material disposed on the inner wall surface of the casing, the heat insulation effect of the casing is enhanced by the heat insulation material, and the problem of dewing on the outer wall surface of the casing during cooling can be diminished.

In addition, since the guide is formed of acoustic material such as acoustic plastic and an air layer is provided between the guide and the casing, the noise can be further reduced.

BEST MODE FOR CARRYING OUT THE INVENTION

First Embodiment

Hereinafter, with reference to the drawings, the description will be made of a first embodiment according to the present invention.

Figure 1:
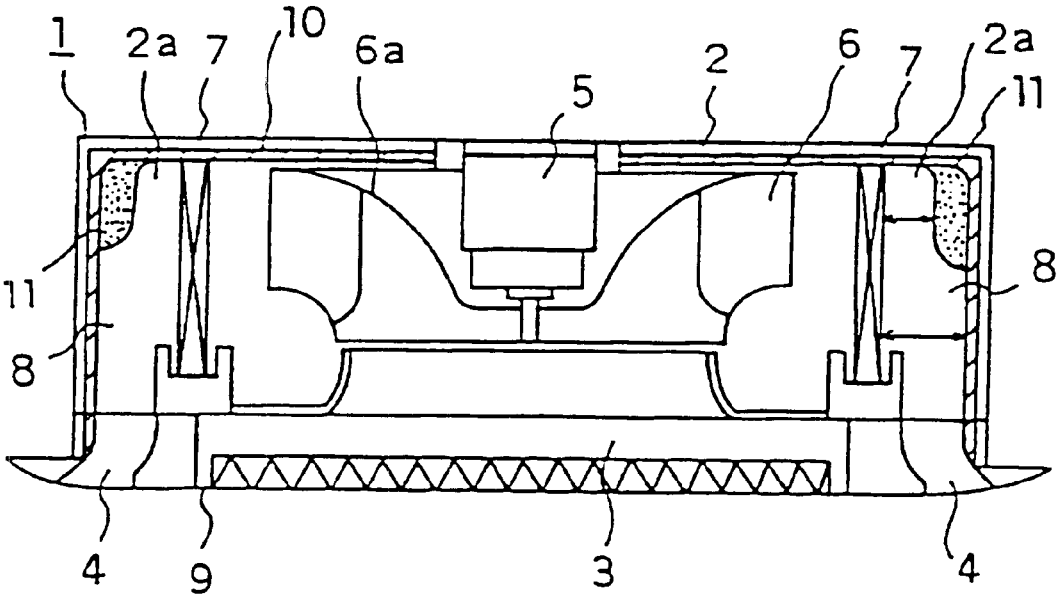
FIG. 1 is a sectional view showing a ceiling embedded-type air conditioner according to a first embodiment of the present invention.
Figure 6:
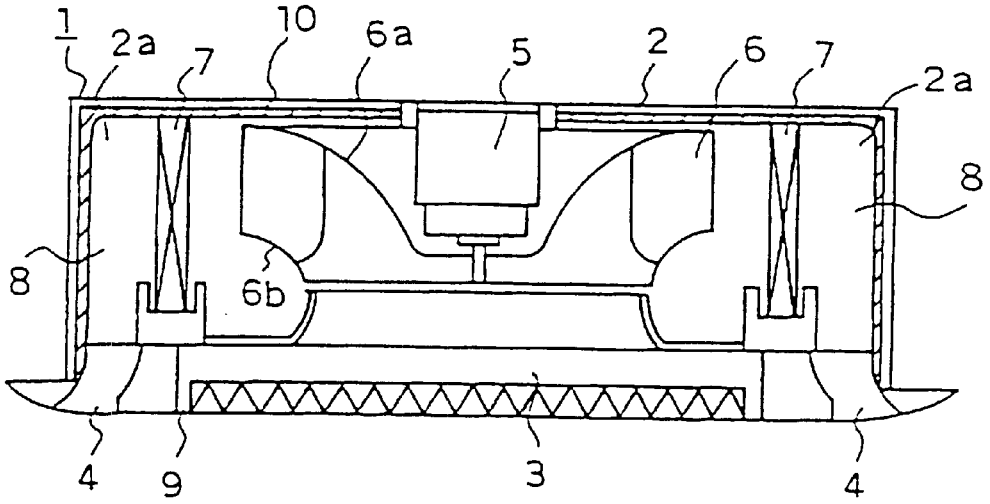
FIG. 6 BACKGROUND ART
FIG. 6 is a sectional view showing a conventional ceiling embedded-type air conditioner.
Figure 7:
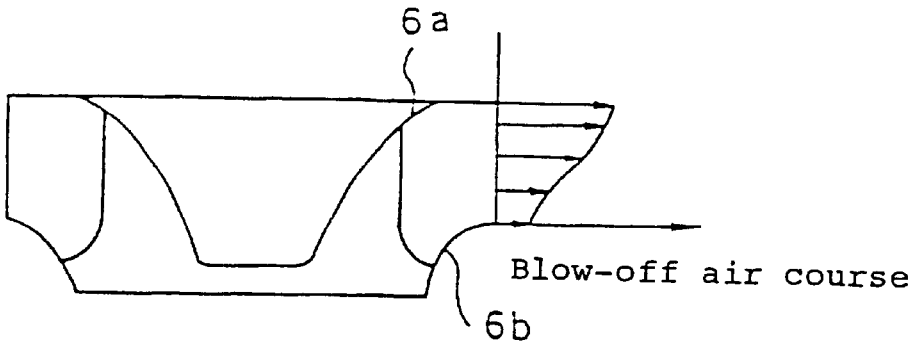
FIG. 7 is a view showing blow-off wind velocity distribution of a blower in the conventional ceiling embedded-type air conditioner.

FIG. 1 is a sectional view showing a ceiling embedded-type air conditioner according to the first embodiment of the present invention. In FIG. 1, reference numerals 1 to 10 denote the same or equivalent portions as in FIG. 6 showing the conventional apparatus. A reference numeral 11 denotes a guide mounted to heat insulation material 10 disposed on the inner wall surface of a casing 2 in a casing corner portion 2*a*. With the provision of the guide 11, a minimum width W1 from the ceiling surface of the casing 2 to the upstream-side blow-off air course near the center of the impeller blade outlet of a centrifugal blower 6 is approximately one third to two thirds of the downstream-side air course width W2.

In a ceiling embedded-type air conditioner configured as described above, when the centrifugal blower 6 is driven by the motor 5, indoor air is sucked into the main body 1 through the suction port 3. The air sucked is bent in a direction at right angles, is pushed out on the heat exchanger 7 side by the centrifugal blower 6, and passes through the heat exchanger 7 to flow out in the blow-off air course 8. At this time, the air having faster wind velocity on the blower main plate 6*a* side is converted into static pressure because the velocity component is restrained by the guide 11 provided on the inner wall surface of the casing 2.

Therefore, the inclination of the wind velocity distribution of the air which passes through the heat exchanger 7 is improved to enhance the heat exchange efficiency.

Since the wind velocity is weakened in the casing corner portion 2*a,* disturbance caused by the occurrence of eddy current is restrained to smoothly flow toward the downstream side, the air which passes below the heat exchanger 7 without the guide 11 is also dragged into it, and the entire air smoothly flows toward the blow-off port 4.

Figure 2:
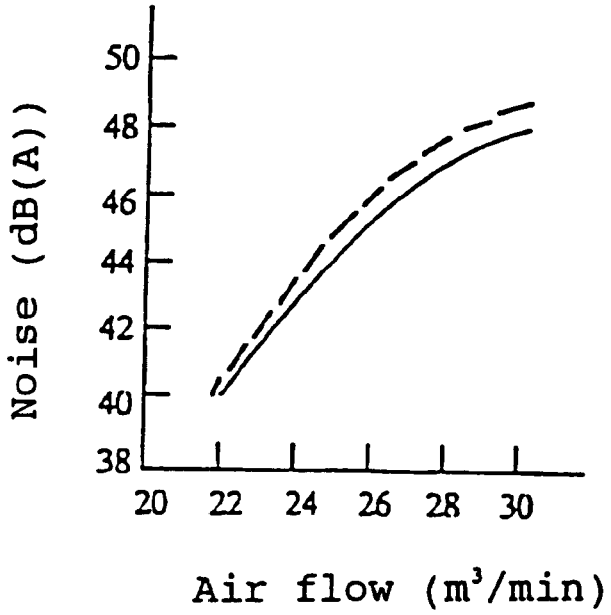
FIG. 2 is a view showing relationship between air flow and noise in an experimental result in which noises with and without any guide are compared.

Therefore, the pressure loss decreases, and the noise is reduced. FIG. 2 shows the experimental result in which noises with and without any guide are compared, and it could be confirmed that the noise is reduced by the provision of the guide 11 as shown in solid line (presence of the guide 11) and in broken line (absence of the guide 11).

Figure 3:
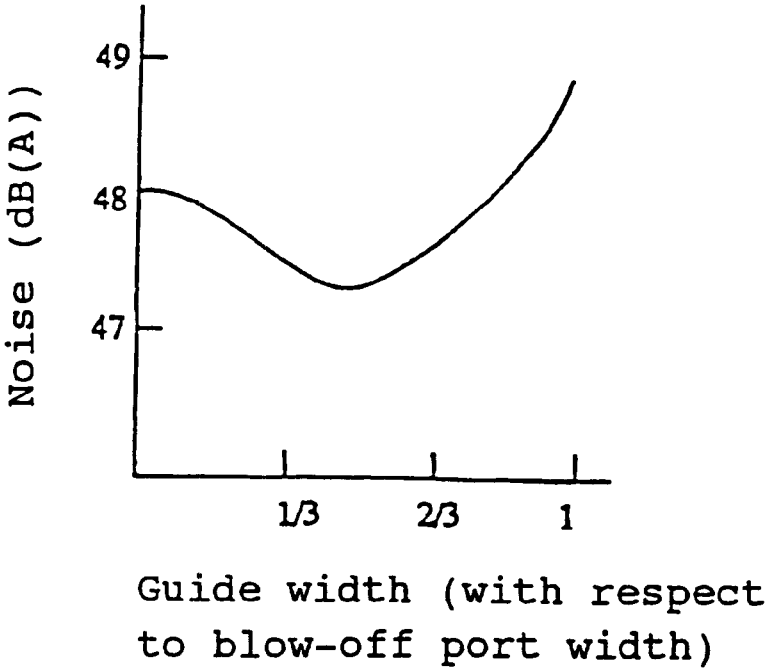
FIG. 3 is a view showing relationship between guide width and noise.

As regards the size of the guide 11, the size of approximately one third to two thirds of the width of the blow-off port 4 is most appropriate as shown in the experimental result in FIG. 3.

According to the above described embodiment, it is possible to uniformalize the wind velocity distribution of the air which passes through the heat exchanger 7, and therefore, it is possible to reduce the pressure loss on passing through the heat exchanger 7, to muffle the noise, to make the most of the performance of the heat exchanger 7, and to reduce the capacity.

Second Embodiment

Figure 4:
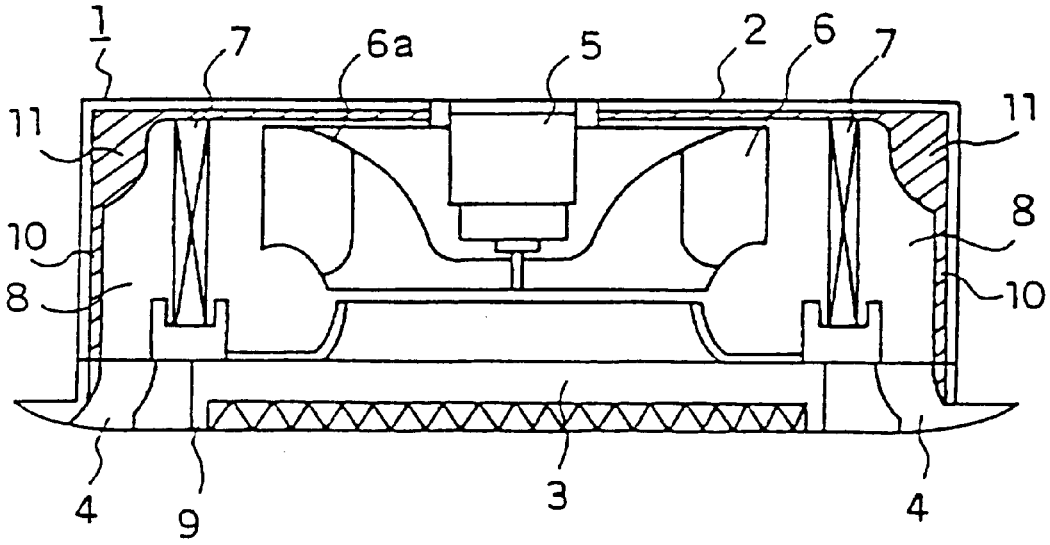
FIG. 4 is a sectional view showing a ceiling embedded-type air conditioner according to a second embodiment.

Although the heat insulation material 10 and the guide 11 are configured by separate components respectively in the first embodiment, the guide 11 may be integrally molded with heat insulation material 10 disposed on the inner wall surface of the casing 2 as shown in FIG. 4.

In addition to the effect of the first embodiment, the heat insulation material 10 can be made thicker, thereby the heat insulation effect can be improved, and dewing preventing effect on the outer wall surface of the casing 2 during cooling can be improved.

Third Embodiment

Figure 5:
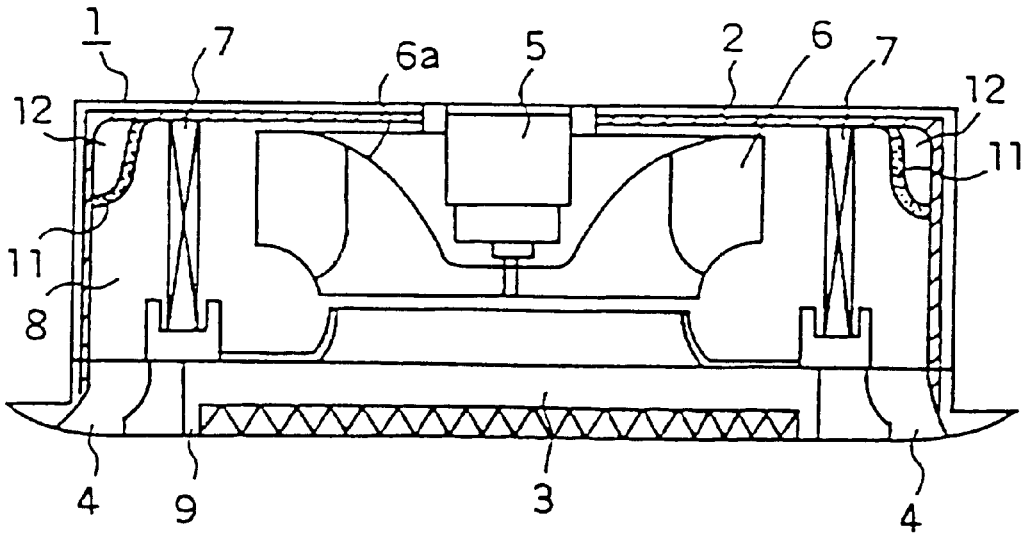
FIG. 5 is a sectional view showing a ceiling embedded-type air conditioner according to a third embodiment.

FIG. 5 shows an air conditioner in which the guide 11 is formed of acoustic material and an air layer 12 is provided between the inner wall surface of the casing 2 and the guide 11. The fluid noise of the air which flows through the blow-off air course 8 is absorbed by the guide 11 formed of the acoustic material and the air layer 12, and therefore, the noise can be further reduced.

We claim:

1. An air conditioner comprising:

A centrifugal blower disposed in a central portion within a casing of an air conditioner main body;

a heat exchanger disposed around said centrifugal blower;

a heat insulation material for forming a blow-off air course disposed between said heat exchanger and an inner wall surface of said casing on said inner wall surface;

a panel mounted to a lower end portion of said casing;

a suction port formed in a central portion of said panel; and a plurality of blow-off ports formed in side edge portions of said panel;

wherein:

said blow-off air course has a narrow portion configured to enhance a uniformity of a velocity distribution of an air flow in said blow-off air course; and said guide comprises an acoustic material and an air layer is provided between said casing and said guide.

2. The air conditioner according to claim 1, wherein said narrow portion comprises a guide configured to narrow said blow-off air course extending along an upstream end to a middle portion of said heat exchanger.

3. The air conditioner according to claim 2, wherein said guide comprises a heat insulation material disposed on the inner wall surface of said casing.

4. The air conditioner according to claim 1, wherein said blow-off air course is one third to two thirds narrower than a remaining portion of said blow-off air course.

5. The air conditioner according to claim 1, wherein said acoustic material comprises an acoustic plastic.

6. An air conditioner comprising:

a centrifugal blower disposed in a central portion within a casing of an air conditioner main body;

a heat exchanger disposed around said centrifugal blower;

a heat insulation material for forming a blow-off air course disposed between said heat exchanger and an inner wall surface of said casing on said inner wall surface;

a panel mounted to a lower end portion of said casing;

a suction port formed in a central portion of said panel; and a plurality of blow-off ports formed in side edge portions of said panel;

wherein said blow-off air course has a narrow portion extending along an upstream end to a middle portion of said heat exchanger;

said narrow portion of said blow-off air course is at least one third narrower than said blow-off air course extending from said central portion of said heat exchanger toward a downstream end of said heat exchanger;

said narrow portion comprises a guide configured to narrow said blow-of air course along the upstream end to the middle portion of said heat exchanger; and said guide comprises an acoustic material and an air layer is provided between said casing and said guide.

7. The air conditioner according to claim 6, wherein said blow-off air course is one third to two thirds narrower than a remaining portion of said blow-off air course.

8. The air conditioner according to claim 6, wherein said guide comprises a heat insulation material disposed on the inner wall surface of said casing.

9. The air conditioner according to claim 6, wherein said acoustic material comprises an acoustic plastic.

10. An air conditioner comprising:

a centrifugal blower disposed in a central portion within a casing of an air conditioner main body;

a heat exchanger disposed around said centrifugal blower;

a heat insulation material for forming a blow-off air course disposed between said heat exchanger and an inner wall surface of said casing on said inner wall surface;

a panel mounted to a lower end portion of said casing;

a suction port formed in a central portion of said panel;

a plurality of blow-off ports formed in side edge portions of said panel;

a guide disposed in said blow-off air course and configured to narrow an upstream side portion of said blow-off air course than a downstream side portion of said blow-off air course; and an air layer provided between said casing and said guide;

wherein said guide comprises an acoustic material.

11. The air conditioner according to claim 10, wherein said acoustic material comprises an acoustic plastic.

* * * * *